US012805634B2

(12) United States Patent
Felsenthal et al.

(10) Patent No.: US 12,805,634 B2
(45) Date of Patent: Nov. 24, 2026

(54) DRAWER DIVIDER

(71) Applicant: Whitmor, Inc., Southaven, MS (US)

(72) Inventors: Sandy A. Felsenthal, Memphis, TN (US); Michael Herndon, Memphis, TN (US); Yi Liu, Southaven, MS (US)

(73) Assignee: Whitmor, Inc., Southaven, MS (US)

( * ) Notice: Subject to any disclaimer, the term of this patent is extended or adjusted under 35 U.S.C. 154(b) by 15 days.

(21) Appl. No.: 18/514,334

(22) Filed: Nov. 20, 2023

(65) Prior Publication Data

US 2024/0164522 A1 May 23, 2024

Related U.S. Application Data

(60) Provisional application No. 63/426,687, filed on Nov. 18, 2022.

(51) Int. Cl.
*A47B 88/975* (2017.01)

(52) U.S. Cl.
CPC ..... *A47B 88/975* (2017.01)

(58) Field of Classification Search
CPC ..... A47F 5/005; A47B 88/975; A47B 88/90
USPC ..... 312/348.3
See application file for complete search history.

(56) References Cited

U.S. PATENT DOCUMENTS

| | | | | | |
|---|---|---|---|---|---|
| 1,849,024 | A * | 3/1932 | Mckee | A47B 88/969 | 220/551 |
| 1,919,568 | A * | 7/1933 | Mccosh | A47B 88/994 | 52/630 |
| D473,080 | S * | 4/2003 | Kellogg | D6/706 | |
| 9,549,623 | B1 * | 1/2017 | Snell | A47B 88/975 | |
| 10,219,623 | B1 * | 3/2019 | Dibdin | A47F 5/005 | |
| D1,011,813 | S * | 1/2024 | Mao | D6/706 | |
| D1,023,652 | S * | 4/2024 | Greenwood | D6/706 | |
| D1,052,318 | S * | 11/2024 | Xie | D6/706 | |
| 2003/0137227 | A1 * | 7/2003 | Hoenig | A47B 88/90 | 312/348.3 |
| 2014/0210331 | A1 * | 7/2014 | Tunzi | F25D 25/00 | 29/428 |
| 2024/0164522 | A1 * | 5/2024 | Felsenthal | A47B 88/975 | |
| 2025/0009128 | A1 * | 1/2025 | Yang | A47B 88/975 | |

* cited by examiner

*Primary Examiner* — Muhammad Ijaz
(74) *Attorney, Agent, or Firm* — Stites & Harbison PLLC; Patrick M. Torre

(57) ABSTRACT

A retractable drawer divider includes a toothed plate telescopically arranged in a fixed plate and provided with two rows of first tooth parts arranged at intervals, wherein the toothed plate may be placed in at least a first state and a second state. A switch assembly for transitioning the toothed plate between the first and second state includes a locking block, a movable block, a pull rod and a button. The first state is an adjustable state in which the toothed plate can be freely extended and retracted, and the second state defines a fixed or locked state of the drawer divider. The drawer divider length can be adjusted easily and freely according to the size of the drawer environment, and in the locked state provides a snug fit between the divider and an inner wall of a drawer.

21 Claims, 7 Drawing Sheets

DRAWER DIVIDER

RELATED APPLICATIONS

This application claims priority to U.S. provisional patent application Ser. No. 63/426,687 filed on Nov. 18, 2022, the entirety of the disclosure of which is incorporated herein by reference.

TECHNICAL FIELD

The presently disclosed subject matter is directed to a drawer partition or divider used to separate an inner space of a drawer, so as to effectively and flexibly adapt the inner space of the drawer.

BACKGROUND

Drawer dividers have been increasingly used in various types of storage furniture. They can be separated at the desired position in a removable/removable manner, so as to reasonably plan the storage space, so that the objects stored in the drawer can be better organized.

There are many types of known dividers, with various structures. Among them, there is a type of telescopic divider, one end of which is retractable. For example, "a multi-purpose telescopic partition board that can be grafted, lengthened and heightened," disclosed in CN 211354593U, discloses such a telescopic partition board structure. The pull plate of the multi-purpose telescopic partition board can move forward or backward in the fixed plate when the button switch is turned on, so that the extension length of the pull plate can be adjusted; when the button switch is turned off, the pull plate is fixed and cannot be moved. However, this telescopic partition board has many parts and is a complicated structure. The installation of the partition board is difficult, which affects its convenience and practicability. In addition, if the first connecting plate cannot be pressed tightly against the inner wall of the drawer, it is unstable and may tilt and roll over.

Based on this, there is a need for a drawer divider that is simple in structure, easy to use, stable, and able to be securely installed.

SUMMARY

The presently-disclosed subject matter meets some or all of the above-identified needs, as will become evident to those of ordinary skill in the art after a study of information provided in this document.

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features.

In one aspect, the present disclosure provides a retractable drawer partition plate which is convenient to use, has strong pre-tightening pressure and is stable.

In embodiments, the retractable drawer partition plate comprises a fixed plate, a toothed plate, and a switch assembly. The switch assembly allows the toothed plate to have at least a first state and a second state. The first state is an adjustable state in which the toothed plate can be freely extended and retracted, and the second state is a preset, locked, or fixed state of the toothed plate.

The switch assembly includes a locking block that is slidably arranged between the two rows of the first tooth parts of the toothed plate, and is provided with a second tooth part that can be engaged with the first tooth parts.

A movable block is slidably arranged on the toothed plate, and links the locking block to make the second tooth part of the locking block engage with the first tooth part or disengage the second tooth part from the first tooth part. A pull rod connected to the movable block can move left or right horizontally. An elastic piece is arranged between the tie rod and the movable block. A button is located on the fixed plate and is used to drive the pull rod.

When the button is actuated in a first direction, the second tooth on the locking block is disengaged from the first tooth on the toothed plate, and the toothed plate is in the first state. When the locking block engages with the first tooth on the toothed plate, and the elastic member is compressed, the toothed plate has a tendency to move to the right. At this point, the toothed plate is in the second state.

A fixing plate with two rows of first tooth parts arranged at intervals has a switch assembly that can enable the toothed plate to have at least a first state and a second state. The first state is an adjustable state in which the toothed plate can be freely extended and retracted. The second state is a locking state in which the toothed plate is pre-pressed, locked, or fixed.

The switch assembly includes a locking block, which is slidably arranged between the two rows of first tooth portions of the toothed plate, and can be connected with the first tooth. The second tooth part meshes with the first tooth part. The movable block can be slidably arranged on the toothed plate, and can interlock the locking block to make the second tooth part of the locking block mesh with the first tooth part or the second tooth part and the first tooth part.

When the teeth are disengaged, the pull rod is connected with the movable block and can move horizontally to the left or right. The elastic piece can be set between the pull rod and the movable block, and the button can be set on the fixed plate to drive the pull rod.

When the button is actuated in a first direction, the second tooth part on the locking block is disengaged from the first tooth part on the toothed plate, and the toothed plate is in the first state. When the locking block engages with the first tooth on the toothed plate, and the elastic member is compressed, the toothed plate has a tendency to move to the right. At this point, the toothed plate is in the second state.

When the elastic member is restored, the toothed plate also returns to the original state of the partition plate. At this point, the toothed plate can only move to the left. During the movement process, the elastic member is compressed so that the toothed plate always has the right mobile trend.

Further, the locking block has a pair of parallel cantilever arms in the horizontal direction, and the second tooth portion is provided at the free end of the cantilever arm. When the cantilever arm is acted by an external force, it can expand toward the first tooth portion respectively, so that the second teeth on the cantilever are engaged with the corresponding first teeth.

The movable block can be provided with a fourth gear portion that can act on the two cantilevers to expand outward. This the fourth gear portion is located between the two cantilevers of the locking block and is arranged in a horizontal and vertical direction. In this way, through the left and right movement of the movable block, the action state of the fourth gear part and the cantilever can be changed, so as to achieve the purpose of meshing or disengaging between the second tooth part and the first tooth part.

The locking block also has upper and lower frames arranged horizontally and a crosspiece vertically connected between the upper and lower frames, and the two cantilevers are respectively formed by extending the upper and lower frames to the right. In this way, the left part of the locking block is a non-closed mouth shape, which is favorable for setting the movable block, so that the movable block can move left and right inside.

Further, the movable block can be slidably constrained between the upper and lower frames of the locking block, and there are also four acting parts spaced apart in the length direction of the movable block for the linkage between the pull rod and the locking block. The four acting parts are the first gear part, the second gear part, the third gear part and the fourth gear part in sequence from left to right. The fourth gear part is placed on the left and right sides of the crosspiece of the locking block, and in the first state, the fourth gear part is in contact with the crosspiece. When the button is turned on, the movable block moves to the left and gradually releases the force on the cantilever. When the maximum stroke is reached, the fourth gear part collides with the crosspiece of the locking block.

The first gear portion and the second gear portion of the movable block are spaced apart by a first cavity, and the second gear portion and the third gear portion are spaced apart by a second cavity.

The tie rod has a left rod part and a right frame part, the frame part is provided with two action parts that cooperate with the movable block, and the two action parts are the first crosspiece in sequence from left to right. In one state, the first rung is in contact with the first stop of the movable block, and the second rung is in contact with the second stop of the movable block. In the second state, the second rung of the movable block is in contact with the third gear part of the movable block. In this way, when the button is closed the first crosspiece of the pull rod can exert force on the elastic member to deform it under pressure, until the second crosspiece of the pull rod collides with the third block of the movable block. At this time the pull rod is moving towards the maximum stroke of the right can no longer be moved, and the movable block can also drive the locking block and the toothed plate to move to the right under the action of the restoring force of the elastic member. When the elastic member returns to the original state of no deformation, the first gear of the movable block collides with the first rail of the draw rod, and the second gear of the active block collides with the second rail of the draw rod. At this time, the toothed plate, the locking block and the movable block can only be moved to the left, and the maximum movable distance is the distance of the active space left by the preload (that is, in the initial state, the distance between the second rung of the pull rod and the third gear of the movable block) distance), the elastic piece will be compressed during the movement, and the toothed plate will always have a tendency to move to the right under the action of the elastic force, so that the inner wall of the drawer can be pressed tightly.

In embodiments of the invention, the elastic member is a spring, which is arranged between the first rail of the draw rod and the second rail of the movable block. During the opening of the button, the spring is not compressed and does not deform during the entire process.

The push button is a push-pull type, an oblique slot is arranged on the button, and one end of the pull rod is inserted into the slot. In this way, by pulling up or pushing down the button, the lever can move horizontally to the left or right in the track of the slot.

The fixing plate is formed by combining two side plates, the locking block is located between the toothed plate and one of the side plates of the fixing plate, and the side plate is provided with a pair of the side plates. The locking block, the movable block and the groove cavity for the limit guide of the pull rod.

In embodiments of the invention, anti-skid pads may be arranged at both ends of the partition plate, wherein an anti-skid pad is arranged on the exposed end of the toothed plate to play the role of anti-skid and buffer.

Compared with the prior art, the advantages of the present utility model include the relatively simple structure convenience in operation, the length being adjustable according to the size of the drawer, and the locked position after being adjusted to fit the drawer. The locking function permits a close fit between the partition plate and the inner wall of the drawer.

BRIEF DESCRIPTION OF THE DRAWINGS

Illustrative and preferred embodiments of the present invention are shown in the accompanying drawings described below.

FIG. 2 is a cutaway schematic diagram of an embodiment of the present invention when the button is turned on.

FIG. 5 is a schematic diagram of an embodiment of the present invention when the button is turned on.

FIG. 6 is a schematic diagram reflecting the bidirectional movement of the toothed plate after the button is turned on.

DETAILED DESCRIPTION

Figure 1:
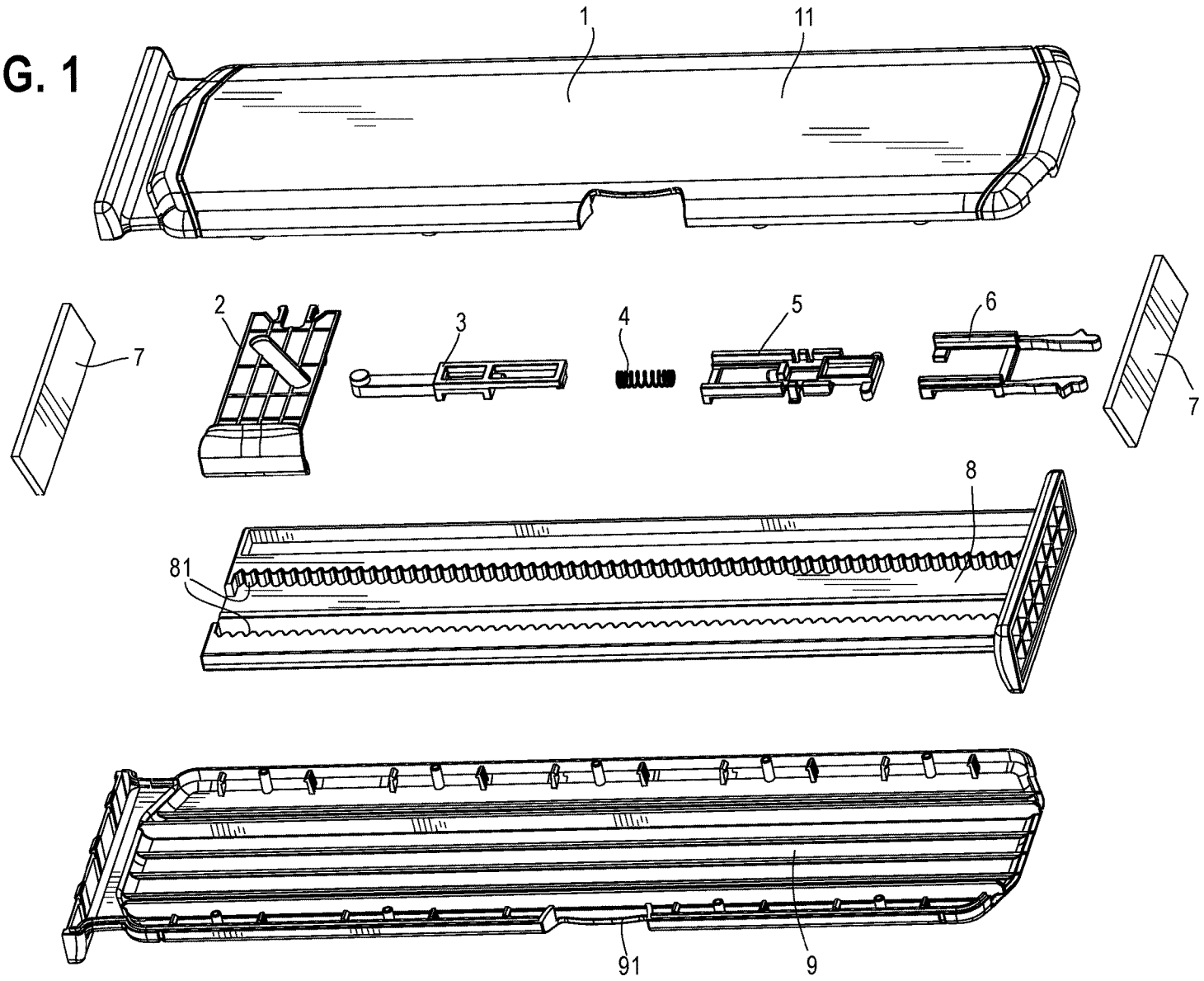
FIG. 1 shows a perspective exploded schematic diagram of an embodiment of the present invention.

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

It will be understood that various details of the presently disclosed subject matter can be changed without departing from the scope of the subject matter disclosed herein.

Furthermore, the foregoing description is for the purpose of illustration only, and not for the purpose of limitation.

While the terms used herein are believed to be well understood by those of ordinary skill in the art, certain definitions are set forth to facilitate explanation of the presently-disclosed subject matter.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

An embodiment of the present invention will be further described in detail below with reference to the embodiments of the accompanying drawings.

The retractable drawer divider is mainly composed of a fixed plate, a toothed plate 8 and a switch assembly composed of a button 2, a locking block 6, a movable block 5, a pull rod 3 and a spring 4.

The fixed plate is composed of the front and rear side plates 1 and 9, in which the toothed plate 8 and the switch assembly can be arranged, wherein a groove 11 for arranging buttons is correspondingly provided on the top of the front and rear side plates 1, 9, so that the button 2 can be slidably arranged between the toothed plate 8 and the front side plate 1. On the inner wall of the front side plate on the right side of the groove, there is also a groove cavity 12 which is arranged with the switch assembly for limiting and guiding the locking block 6, the movable block 5 and the pull rod 3.

Button 2 is a push-pull type, and the push-pull direction is in an up-and-down direction relative to a horizontal orientation of the drawer divider. The button 2 is provided with a slot 21 (see FIG. 2) whose top is on the right side and is inclined downward. In the initial state, the pull rod 3 is connected to the top of the slot 21, so that the up and down action of the button 2 can drive the pull rod 3 horizontally, moving the locking block left or right.

The toothed plate 8 is installed between the front and rear side plates 1 and 9, and can be moved and retracted. One end of the toothed plate 8 is exposed, and the exposed end face is provided with a non-slip pad 7, and the other end of the fixed plate is also provided with a non-slip pad 7, which can provide anti-slip and buffering. The side of the toothed plate 8 opposite to the front side plate 1 is formed with two rows of serrations arranged at intervals, namely the first toothed portion 81. The first toothed portion 81 is arranged in a length direction of the toothed plate 8, and the two rows of the first toothed portion are opposite one another. The side of the toothed plate 8 opposite to the rear side plate and the rear side plate 9 are provided with grooves and protruding ribs that can be fitted with each other, which can limit the position of the toothed plate 8 in the width direction and guide in the length direction.

The locking block 6, the movable block 5, the pull rod 3 and the spring 4 in the switch assembly can be slidably arranged between the two rows of the first toothed portion 81 of the toothed plate 8.

Figure 8:
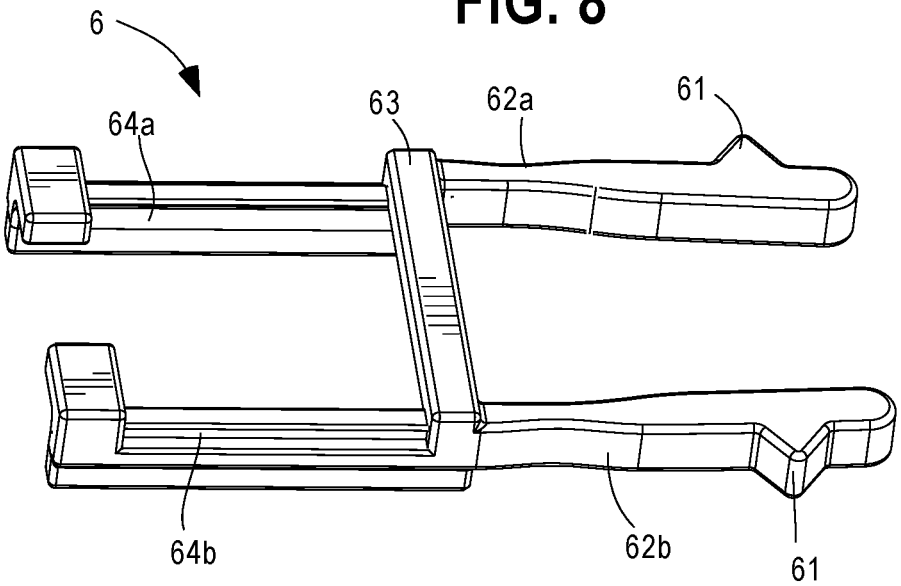
FIG. 8 is a schematic structural diagram of a locking block according to an embodiment of the present invention.
Figure 9:
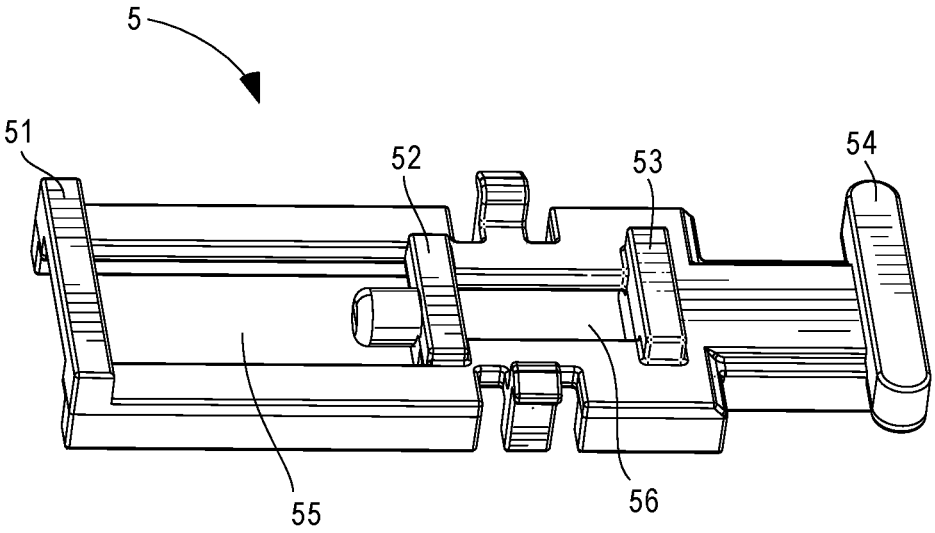
FIG. 9 is a schematic structural diagram of a movable block according to an embodiment of the present invention.
Figure 10:
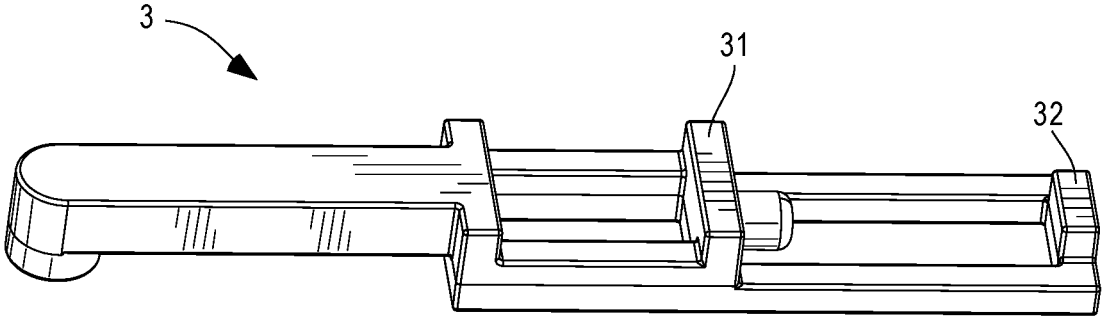
FIG. 10 is a schematic diagram of the structure of a pull rod according to an embodiment of the present invention.
Figure 11:
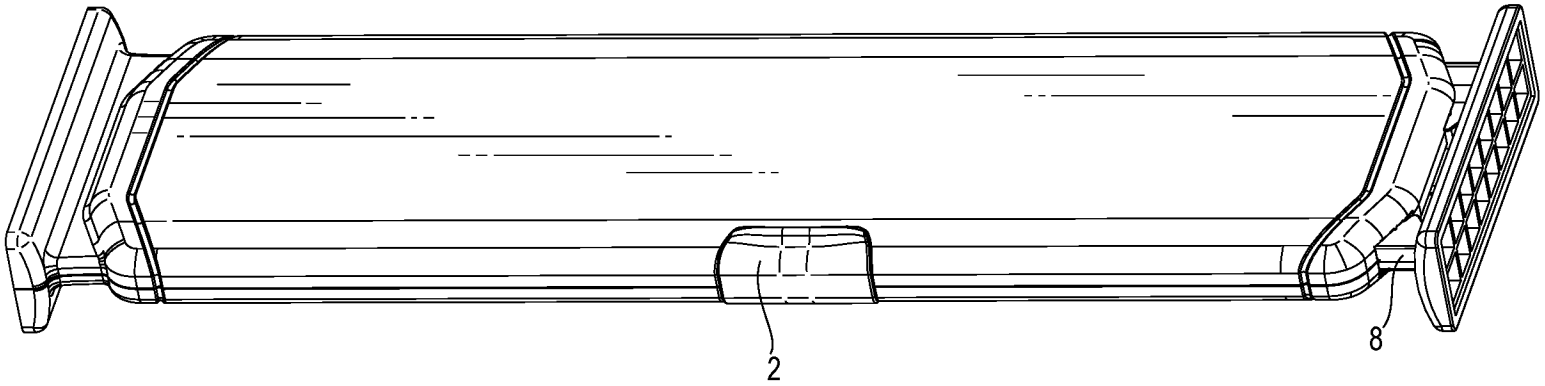
FIG. 11 is a three-dimensional schematic diagram of an embodiment of the present invention.

As shown in FIG. 8, the left part of the locking block 6 is a non-closed mouth shape, with upper and lower frames 64*a*, 64*b* arranged horizontally and vertically connected by rung 63. Rung 63 can be used to set the movable block 5, so that the movable block 5 can have left and right movement relative to the drawer divider horizontal orientation. The right part of the locking block 6 is defined by two parallel cantilever arms 62*a*, 62*b* formed by the upper and lower frames extending to the right respectively. The free ends of the cantilever arms are provided with a second tooth portion 61, and the cantilever arms are sufficiently flexible to be affected by external force. In use, cantilever arms 62*a*, 62*b* can bias toward the first tooth portion 81 respectively, so that the second tooth portion 61 on the cantilever engages with the corresponding first tooth portion 81.

Figure 4:
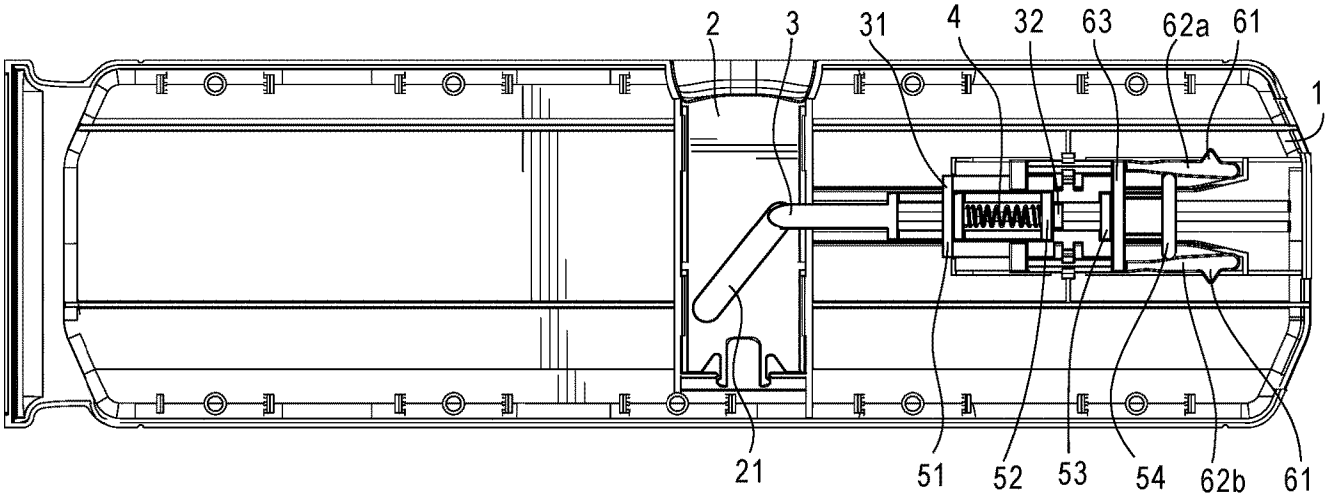
FIG. 4 is a schematic diagram of an embodiment of the present invention in an initial state.
Figure 5:
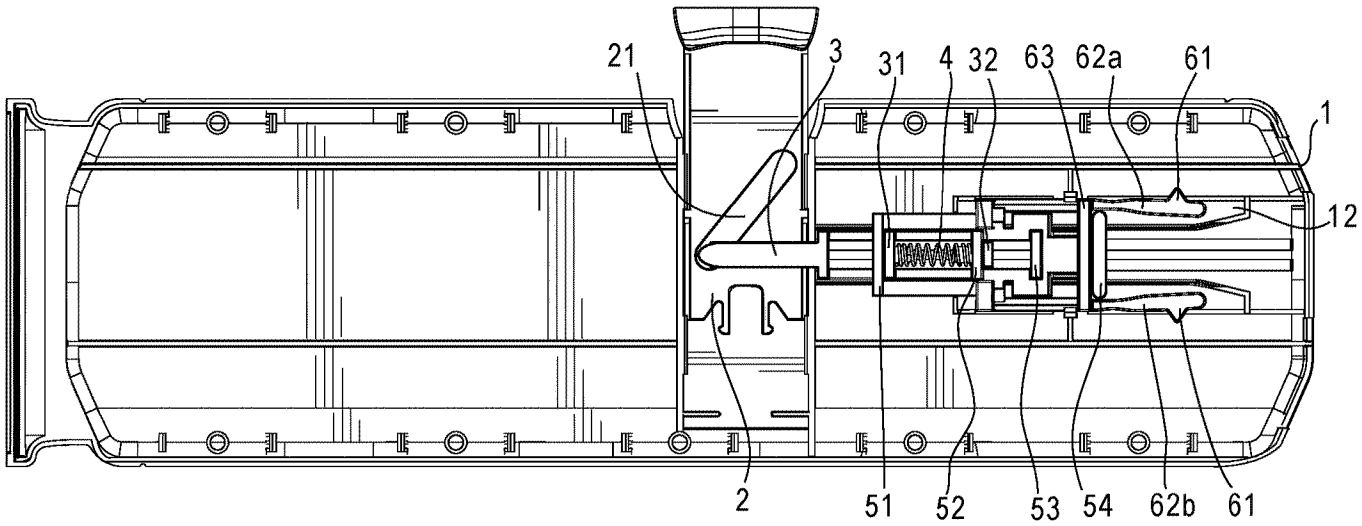
Figure 6:
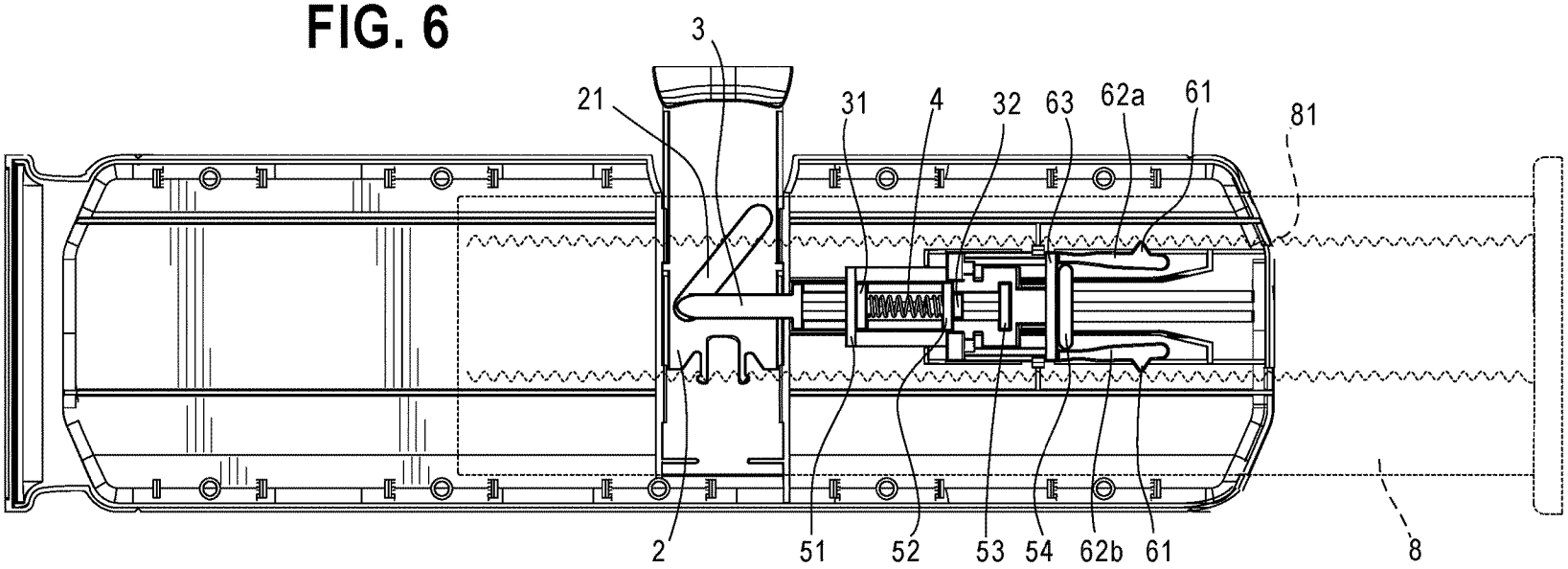

As shown in FIG. 3-7, the movable block 5 can be linked with the locking block 6 to urge the second tooth portion 61 of the locking block 6 to engage with or disengage from the first tooth portion 81. The movable block 5 is a frame-shaped member, which can be slidably constrained between the upper and lower frames 64*a* and 64*b* of the locking block. Four matching pull rods 3 and locks are arranged at intervals along the length direction of the movable block 5. The acting parts for the locking block 6 on movable block 5 are the first gear part 51, the second gear part 52, the third gear part 53, and the fourth gear part 54 in order from left to right. The parts are in a horizontal and vertical direction, and the first gear part 51 and the second gear part 52 are separated by a first cavity 55. The second gear part 52 and the third gear part 53 are separated by a second cavity 56 interval, wherein the third gear portion 53 and the fourth gear portion 54 are located on the left and right sides of the crosspiece 63 of the locking block 6. The fourth gear portion 54 and the crosspiece 6 are in the first state 3 offset. In the second state, the third gear portion 53 and the cross member 63 offset. The first state described herein is an adjustable state in which the toothed plate 8 can be freely extended and retracted, as shown in FIGS. 4 and 5, and the second state is a locked state in which the toothed plate 8 is fixed, as shown in FIG. 6.

Figure 2:
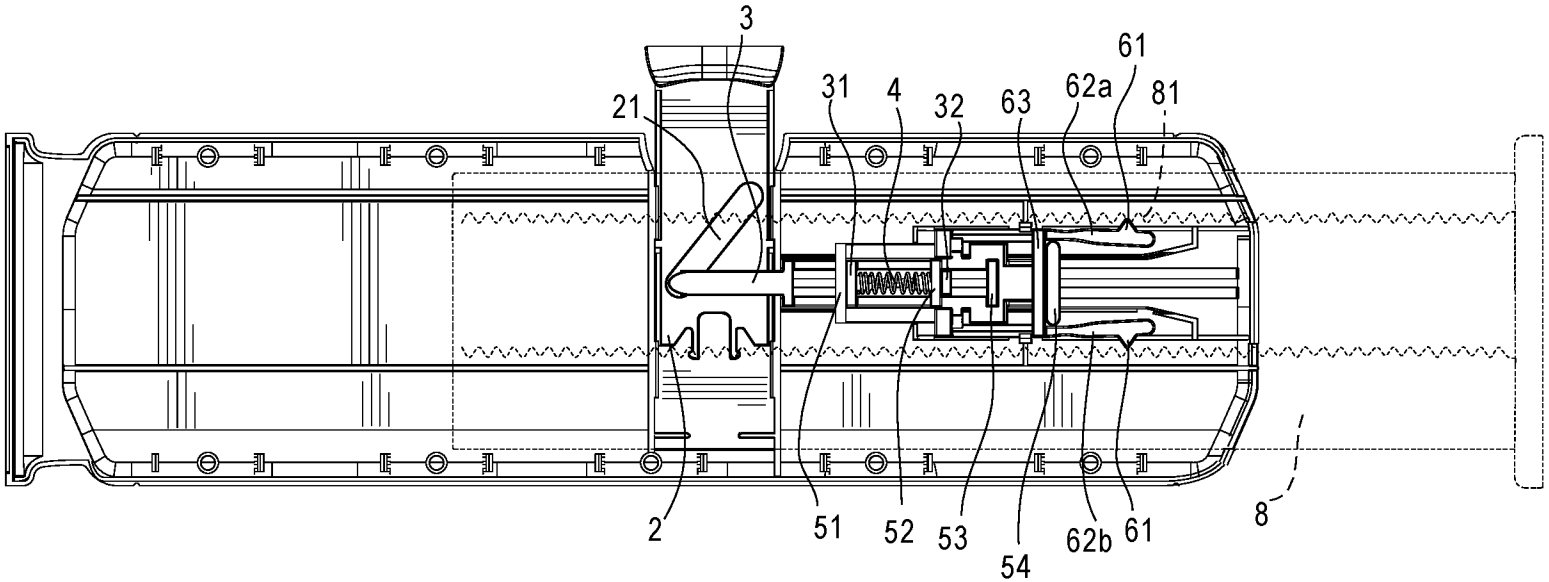
Figure 3:
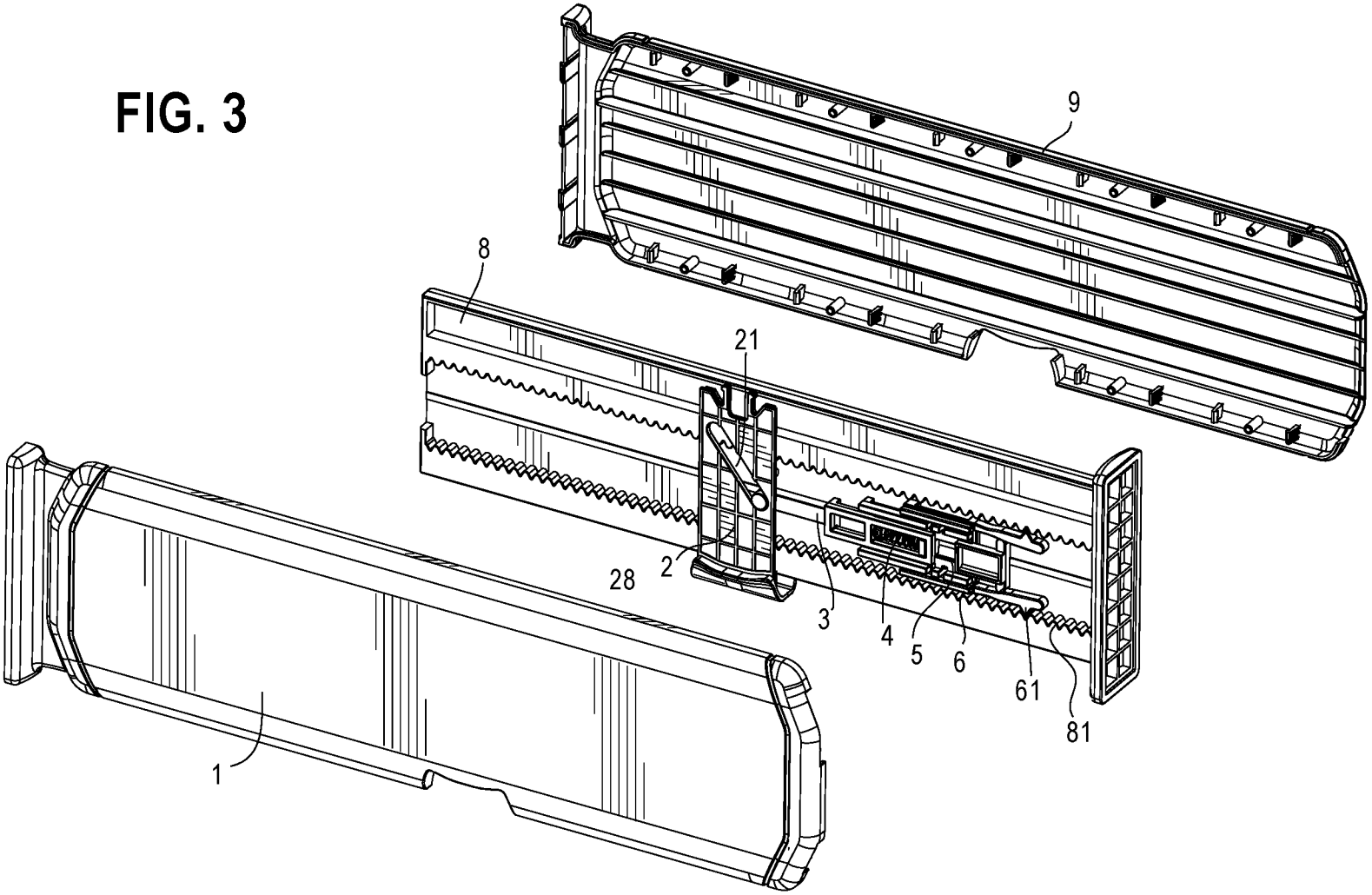
FIG. 3 shows a second perspective exploded schematic view of the embodiment of the present invention.

The pull rod 3 is connected between the button 2 and the movable block 5, as shown in FIG. 2. The frame body is provided with two action parts that cooperate with the movable block 5. The two action parts are the first rung 31 and the second rung 32 in sequence from left to right, and each rung is in a horizontal and vertical direction. The first crosspiece 31 is located in the first cavity 55 of the movable block, and the second crosspiece 32 is located in the second cavity 56 of the movable block. In the first state, the first crosspiece 31 is connected to the movable block. The first gear part 51 of the block is in contact with each other, and the second rail 32 is in contact with the second gear part 52 of the movable block; in the second state, the second rail 32 is in contact with the third gear part 53 of the movable block.

The spring 4 is selected as the elastic member, which is arranged between the first crosspiece 31 of the pull rod 3 and the second stopper 52 of the movable block 5. Therefore, when the button 2 is opened, the spring 4 is not compressed in the whole process and will not be deformed.

Turning to FIGS. 4-7, the dynamic process of the drawer divider in use is described. In the initial state, as shown in FIG. 4, the fourth gear portion 54 of the movable block 5 acts on the cantilever arms 62*a* and 62*b*, and the cantilever arms 62*a* and 62*b* are in the expanded state. The second tooth portion 61 and the first tooth portion 81 on the toothed plate 8 are in meshing state, and the first gear portion 52, the second gear portion 52 and the third gear portion 53 of the movable block 5 are respectively connected with the pull rod. The first rung 31, the second rung 32 and the rung 63 of the locking block 6 are in contact with each other. Therefore, in the initial state, without actuating the button 2, the toothed plate 8 can only move to the left (the locking block 6 and the movable block 5 also move together when moving), and the maximum distance of movement is the second crosspiece 32 of the tie rod 3. The distance between it and the third gear part 53 of the movable block 5 (that is, the distance of the movable space left by the preload), since the movable block 5 also moves to the left together, the spring 4 is also gradually compressed during the movement process, so that the toothed plate 8 will be subjected to the force of the spring 4, so that it has a tendency to move to the right, so that the toothed plate 8 can be pressed against the inner wall of the drawer, and the pressing pressure is strong.

When the button 2 is actuated (see FIG. 5), the movable block 5 moves to the left together with the pull rod 3, and the movable block 5 gradually releases the force on the cantilevers 62*a* and 62*b*. When the maximum stroke is reached, the fourth gear part 54 on the second tooth portion 61 on the locking block 6 is disengaged from the first tooth portion 81 when it collides with the crosspiece 63 of the locking block 6. At this time, the toothed plate 8 can slide freely to the left and right. The protruding length of the toothed plate can be adjusted freely. In the whole process of opening the button 2, the spring 4 will not be deformed. In the open state of the button 2, the first gear part 51, the second gear part 52 and the fourth gear part 54 of the movable block 5 are respectively in the same position as the first rail 31 and the second rail 32 of the pull rod 3. The crosspiece 63 of the locking block is in contact with each other, and the toothed plate 8 is in the first state at this time, as shown in FIGS. 5 and 6.

Figure 7:
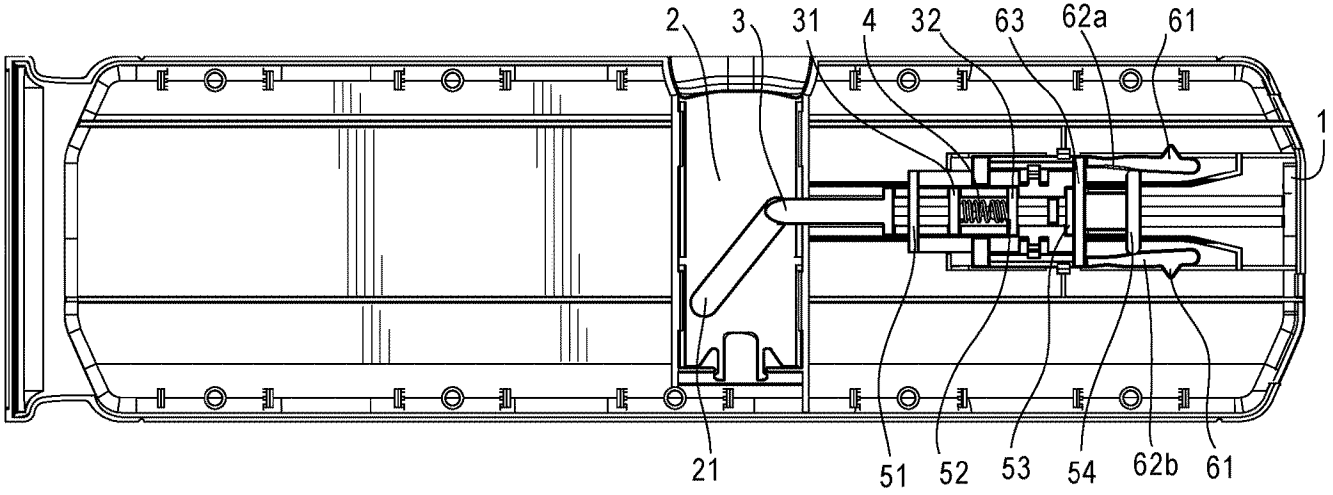
FIG. 7 is a schematic diagram of the toothed plate in the second state when the button is closed.

When the button 2 is closed (FIG. 7), the stroke of the movable block 5 can be divided into two sections: front and rear. The front section is driven by the pull rod 5, so that the movable block 5 moves to the right and reaches the third gear part 53 and the crossbar 63. At this time, the fourth crosspiece 54 has exerted force on the two cantilevers 62*a*, 62*b* to make the cantilevers 62*a*, 62*b* expand outward, the second tooth 61 meshes with the first tooth 81. The spring 4 is in a compressed state, the third gear part 53 of the movable block 5 is in a state of offset with the second crosspiece 32 of the pull rod 3 and the crosspiece 63 of the locking block 6, and this section of the stroke is already the pull rod 3 to the right. The maximum stroke of the motor can no longer be moved, and the toothed plate 8 is in the second state, as shown in FIG. 7. The block 8 continues to move to the right as a whole, so this stroke can also make the toothed plate 8 closely fit with the top of the inner wall of the drawer. When the spring 4 returns, the toothed plate 8 returns to the initial state of step a. As shown in FIG. 4, the latter part of the stroke leaves an active space for preloading.

Any publications, patents, and patent applications mentioned in this specification are herein incorporated by reference to the same extent as if each individual publication, patent, or patent application was specifically and individually indicated to be incorporated by reference. It will be understood that various details of the presently disclosed subject matter can be changed without departing from the scope of the subject matter disclosed herein. Furthermore, the foregoing description is for the purpose of illustration only, and not for the purpose of limitation.

What is claimed:

1. A retractable drawer divider, comprising:

a fixed plate;

a movable toothed plate telescopically arranged within the fixed plate and including two opposed rows of first teeth, individual teeth of the two opposed rows of first teeth being disposed at spaced intervals; and a switch assembly adapted to convert the movable toothed plate between at least a first state in which the toothed plate can be freely extended and retracted and a second, fixed state whereby the toothed plate is held in a fixed position;

wherein the switch assembly includes:

a locking block slidably arranged on the toothed plate between the two opposed rows of first teeth;

a movable block adapted to actuate the locking block whereby a portion of the locking block engages with or disengages from the two opposed rows of first teeth; and a linear, non-pivoting pull rod adapted to actuate the movable block, the pull rod being slidably attached at a first end to an actuable button carried by the fixed plate and attached at a second end to the movable block.

2. The drawer divider of claim 1, wherein the pull rod is adapted to actuate the movable block to provide a left or right horizontal motion, and further comprising:

an elastic member extending between the pull rod and the movable block; and the button being adapted to drive the linear, non-pivoting pull rod whereby actuating the button in a first direction disengages the locking block from the two opposed rows of first teeth placing the toothed plate in the first state, and actuating the button in a second, opposed direction engages the locking block with the two opposed rows of first teeth, compresses the elastic member, and places the toothed plate in the second state.

3. The drawer divider according to claim 2, wherein the locking block further has upper and lower frames arranged horizontally and a crosspiece vertically connecting the upper and lower frames, the upper and lower frames respectively defining a pair of parallel cantilever arms.

4. The drawer divider according to claim 3, wherein the pair of parallel cantilever arms each respectively includes a second tooth portion disposed on a free end thereof.

5. The drawer divider according to claim 4, wherein the movable block is provided with a gear element adapted to bias the pair of parallel cantilever arms.

6. The drawer divider according to claim 5, wherein the movable block is dimensioned and adapted to be slidably disposed between the upper and lower frames of the locking block.

7. The drawer divider according to claim 6, wherein the gear element is positioned between the pair of parallel cantilever arms when the movable block is slidably disposed between the upper and lower frames of the locking block.

8. The drawer divider according to claim 7, wherein the movable block further includes along a length dimension thereof a first gear part, a second gear part, a third gear part and a fourth gear part disposed in sequence from left to right whereby when the movable block is slidably held between the upper and lower frames of the locking block the third gear part and the fourth gear part are positioned on the left and right sides of the locking block crosspiece such that the fourth gear part abuts against the locking block crosspiece when the toothed plate is placed in the first state and the third gear part abuts against the locking block crosspiece when the toothed plate is placed in the second state.

9. The drawer divider according to claim 8, wherein the first gear part and the second gear part of the movable block are spaced apart by a first cavity, and the second gear part and the third gear part are separated by a second cavity.

10. The drawer divider according to claim 2, wherein the elastic member is a spring extending between the pull rod and the movable block.

11. The drawer divider according to claim 2, wherein the button is provided with an elongated oblique slot adapted to slidably receive and retain an end of the pull rod.

12. The drawer divider according to claim 1, wherein the fixed plate is defined by two side plates and the toothed plate, the locking block, the movable block and the pull rod are disposed between the two side plates;

further wherein at least one of the two side plates includes a groove adapted to hold and/or guide the toothed plate, the locking block, the movable block and the pull rod.

13. The drawer divider according to claim 1, wherein the fixed plate and the toothed plate each include an exposed end face provided with a non-slip pad.

14. A retractable drawer divider, comprising:

a fixed plate;

a movable toothed plate telescopically arranged within the fixed plate and including two opposed rows of first teeth, individual teeth of the two opposed rows of first teeth being disposed at spaced intervals;

a switch assembly adapted to convert the movable toothed plate between at least a first state in which the toothed plate can be freely extended and retracted and a second, fixed state whereby the toothed plate is held in a fixed position;

wherein the switch assembly includes:

a locking block slidably arranged on the toothed plate between the two opposed rows of first teeth; and a movable block adapted to actuate the locking block whereby a portion of the locking block engages with or disengages from the two opposed rows of first teeth;

a pull rod adapted to actuate the movable block, the pull rod being slidably attached at a first end to an actuable button carried by the fixed plate and attached at a second end to the movable block;

an elastic member extending between the pull rod and the movable block; and the button including an elongated oblique slot engaging the pull rod first end and adapted to drive the pull rod whereby actuating the button in a first direction disengages the locking block from the two opposed rows of first teeth placing the toothed plate in the first state, and actuating the button in a second, opposed direction engages the locking block with the two opposed rows of first teeth, compresses the elastic member, and places the toothed plate in the second state.

15. The drawer divider according to claim 14, wherein the locking block further has upper and lower frames arranged horizontally and a crosspiece vertically connecting the upper and lower frames, the upper and lower frames respectively defining a pair of parallel cantilever arms each respectively including a second tooth portion disposed on a free end thereof.

16. The drawer divider according to claim 15, wherein the movable block is provided with a gear element adapted to bias the pair of parallel cantilever arms.

17. The drawer divider according to claim 16, wherein the movable block is dimensioned and adapted to be slidably disposed between the upper and lower frames of the locking block.

18. The drawer divider according to claim 17, wherein the gear element is positioned between the pair of parallel cantilever arms when the movable block is slidably disposed between the upper and lower frames of the locking block;

further wherein the movable block includes along a length dimension thereof a first gear part, a second gear part, a third gear part and a fourth gear part disposed in sequence from left to right whereby when the movable block is slidably held between the upper and lower frames of the locking block the third gear part and the fourth gear part are positioned on the left and right sides of the locking block crosspiece such that the fourth gear part abuts against the locking block crosspiece when the toothed plate is placed in the first state and the third gear part abuts against the locking block crosspiece when the toothed plate is placed in the second state.

19. The drawer divider according to claim 18, wherein the first gear part and the second gear part of the movable block are spaced apart by a first cavity, and the second gear part and the third gear part are separated by a second cavity.

20. The drawer divider according to claim 14, wherein the elastic member is a spring extending between the pull rod and the movable block.

21. The drawer divider according to claim 14, wherein the fixed plate is defined by two side plates including a groove adapted to hold and/or guide the toothed plate, the locking block, the movable block and the pull rod.

* * * * *